US006341543B1

(12) United States Patent
Hsieh

(10) Patent No.: US 6,341,543 B1
(45) Date of Patent: Jan. 29, 2002

(54) PUSH BAR-TYPED RATCHET WRENCH WITH HIGH TORQUE STRENGTH

(76) Inventor: Shih-Kuei Hsieh, No. 367-1, Pei Yang Road, Fieng Yuan City, Taichung Hsien (TW)

( * ) Notice: Subject to any disclaimer, the term of this patent is extended or adjusted under 35 U.S.C. 154(b) by 0 days.

(21) Appl. No.: 09/654,049

(22) Filed: Sep. 1, 2000

(51) Int. Cl.[7] ..... B25B 13/46
(52) U.S. Cl. ..... 81/63.2
(58) Field of Search ..... 81/60, 61, 62, 81/63, 63.1, 63.2

(56) References Cited

U.S. PATENT DOCUMENTS 2,701,977 A * 2/1955 Stone ..... 81/63.2
5,231,903 A * 8/1993 Bockman, Jr. ..... 81/63.2
6,216,563 B1 * 4/2001 Hsieh ..... 81/63.2

* cited by examiner

*Primary Examiner*—Eileen P. Morgan
*Assistant Examiner*—Joni B. Danganan
(74) *Attorney, Agent, or Firm*—Troxell Law Office PLLC

(57) ABSTRACT

Push bar-type ratchet wrench with high torque strength, including: a stem body having a holding end formed with a slide way transversely passing through the holding end, the slide way having a cross-section with a first longer axis parallel to a plane face of the holding end and a second shorter axis normal to the first axis; a ratchet rotatably positioned in the through hole; a push bar having a detent section and slidably positioned in the slide way, the push bar having a cross-section with a longer horizontal axis and a shorter vertical axis, the horizontal axis and vertical axis of the push bar respectively corresponding to the first axis and second axis of the slide way; and a locating member positioned in the stem body for resiliently pushing the push bar, whereby the detent section is resiliently engaged with the ratchet. The detent section is engaged with the ratchet at a higher position for increasing the torque strength and operation sensitivity thereof.

2 Claims, 12 Drawing Sheets

PUSH BAR-TYPED RATCHET WRENCH WITH HIGH TORQUE STRENGTH

BACKGROUND OF THE INVENTION

The present invention relates to a pushbar-type ratchet wrench, and more particularly to a push bar-type ratchet wrench in which the detent section of the push bar is engaged with the ratchet at a higher position for increasing the torque strength and operation sensitivity thereof.

FIG. 1 shows a conventional push bar-type ratchet wrench 10 including an elongated stem 11, a ratchet 14 rotatably received in a through hole of the head section 12 of the stem 11 for fitting with a nut and a push bar 16 which is a solid bar with circular cross-section. Each of two ends of the push bar 16 is formed with a detent section 17. The push bar 16 is slidably fitted in a slide way 13 of the head section 12 and pressed by a resilient member 18, whereby the push bar 16 can be located at two positions where the detent section 17 on right side or left side is engaged with the ratchet 14 to provide one-way ratchet effect in different directions.

The conventional push bar-type ratchet wrench can hardly bear high torque and has some shortcomings in operation as follows:

As shown in FIG. 1, when counterclockwise wrenching the stem 11, the ratchet 1 is engaged with the detent section 17 of the push bar for driving the ratchet to rotate in the same direction. At this time, at the contact position A, the detent section 17 will exert a tangential application force F onto the teeth of the ratchet 14. The longitudinal component of the force Fy is directed to the ratchet at a position near the center thereof. The ratchet is a hollow structure and has relatively poor structural strength. Therefore, once the application force F reaches a certain value which makes the longitudinal component of the force Fy greater than the bending strength of the ratchet, the ratchet will be deformed and damaged and unable to be further used.

In addition, referring to FIG. 2, in the operation of FIG. 1, the ratchet 14 will exert a reaction force F' onto the push bar 16. The push bar 16 is a solid structure so that it is able to bear the longitudinal component of the force Fy'. However, in the case of excessively great transverse component of the force Fx', the push bar will clog in the slide way 13 and make it impossible to further use the ratchet wrench.

Furthermore, when clockwise wrenching the wrench as shown in FIG. 3, the push bar 16 will be pushed rightward by the ratchet 14 and disengaged from the ratchet to provide a ratchet effect. The contact position A and the axis of the stem contain a relatively small angle θ. Therefore, when the slope face s of the tooth 141 of the ratchet pushes the detent section 17, as shown in FIG. 4, the perpendicular component n2 of the application force N is applied to the push bar 16 to press the push bar 16 against the inner wall of the slide way 13. Therefore, a larger frictional coefficient between the push bar and the inner wall is produced and the ratchet must exert a greater force onto the push bar for transversely pushing the same. As a result, the ratchet effect is insensitive.

In the other types of ratchet wrenches 19 as shown in FIGS. 5 and 6, the ratchets 191 and the detents 192 also have the same shortcomings.

Another conventional ratchet wrench 15 as show in FIGS. 7 and 8, including a push bar 153 slidably fitted in a slide way 152 of a stem 151. Said push bar has a rectangular cross-section and has a detent section 154 formed at one end of which, said detent section 154 is engaged with a ratchet 155. The engagement position B and the axis of the stem 151 contain a small angle θ, so that the wrench 15 also have the same shortcomings.

SUMMARY OF THE INVENTION

It is therefore a primary object of the present invention to provide a push bar-type ratchet wrench with high torque strength, which is able to bear higher torque.

It is a further object of the present invention to provide the above push bar-type ratchet wrench in which the ratchet can be more sensitively operated.

The present invention can be best understood through the following description and accompanying drawings wherein:

DETAILED DESCRIPTION OF THE PREFERRED EMBODIMENTS

Figure 1:
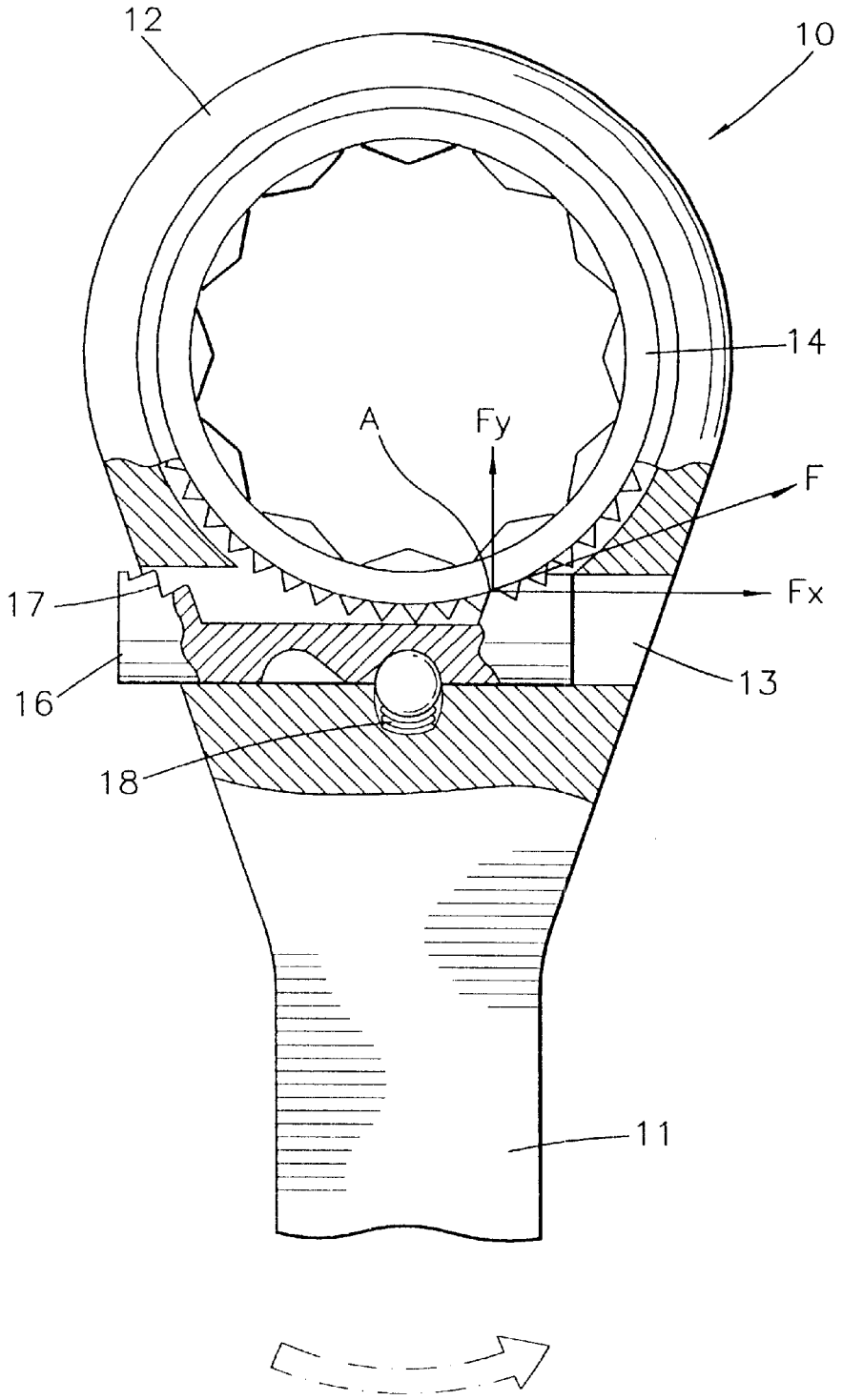
FIG. 1 PRIOR ART
FIG. 1 is a partially sectional view of a conventional push bar-type ratchet wrench.
Figure 2:
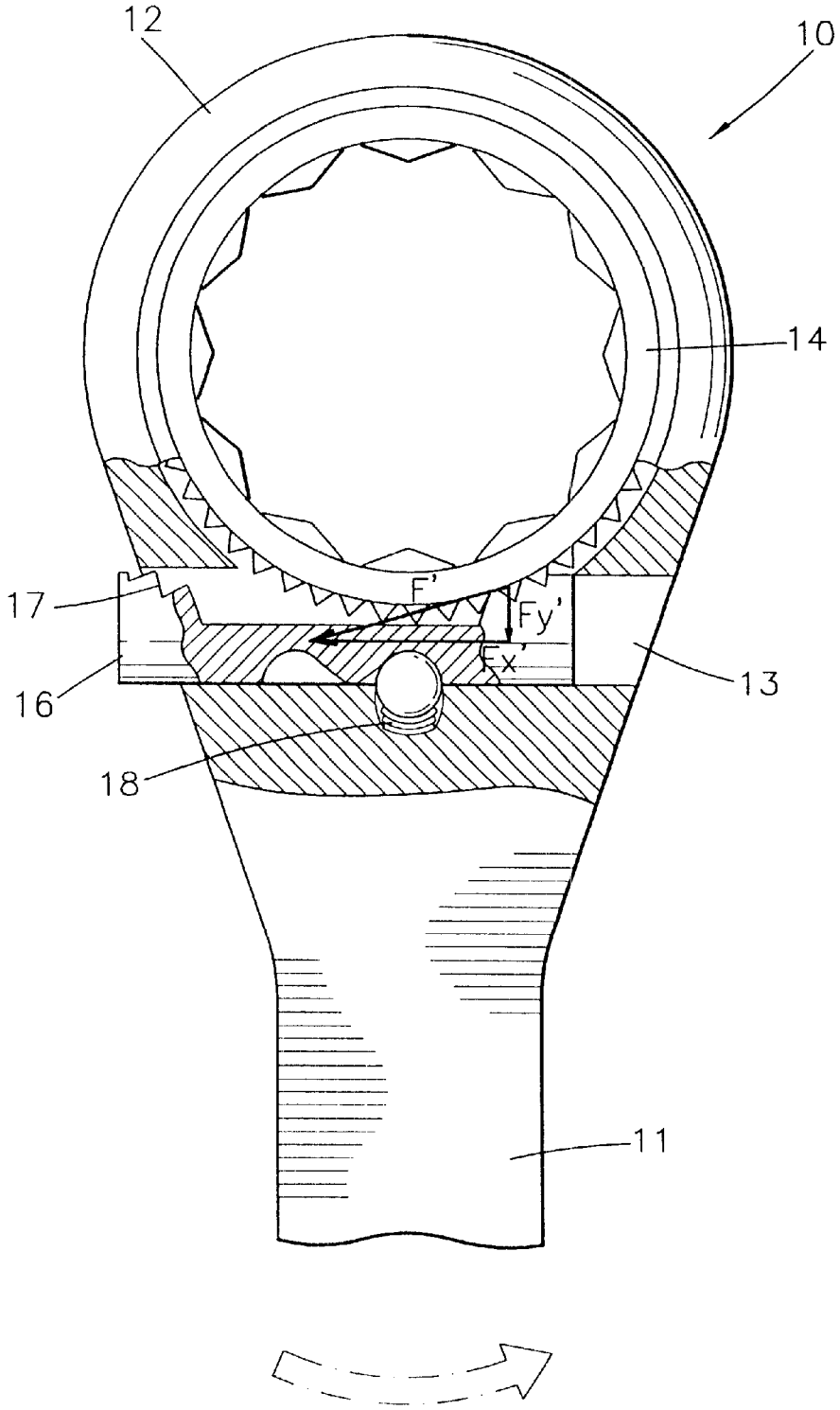
FIG. 2 PRIOR ART
FIG. 2 is a view according to FIG. 1, showing a state of reaction force.
Figure 3:
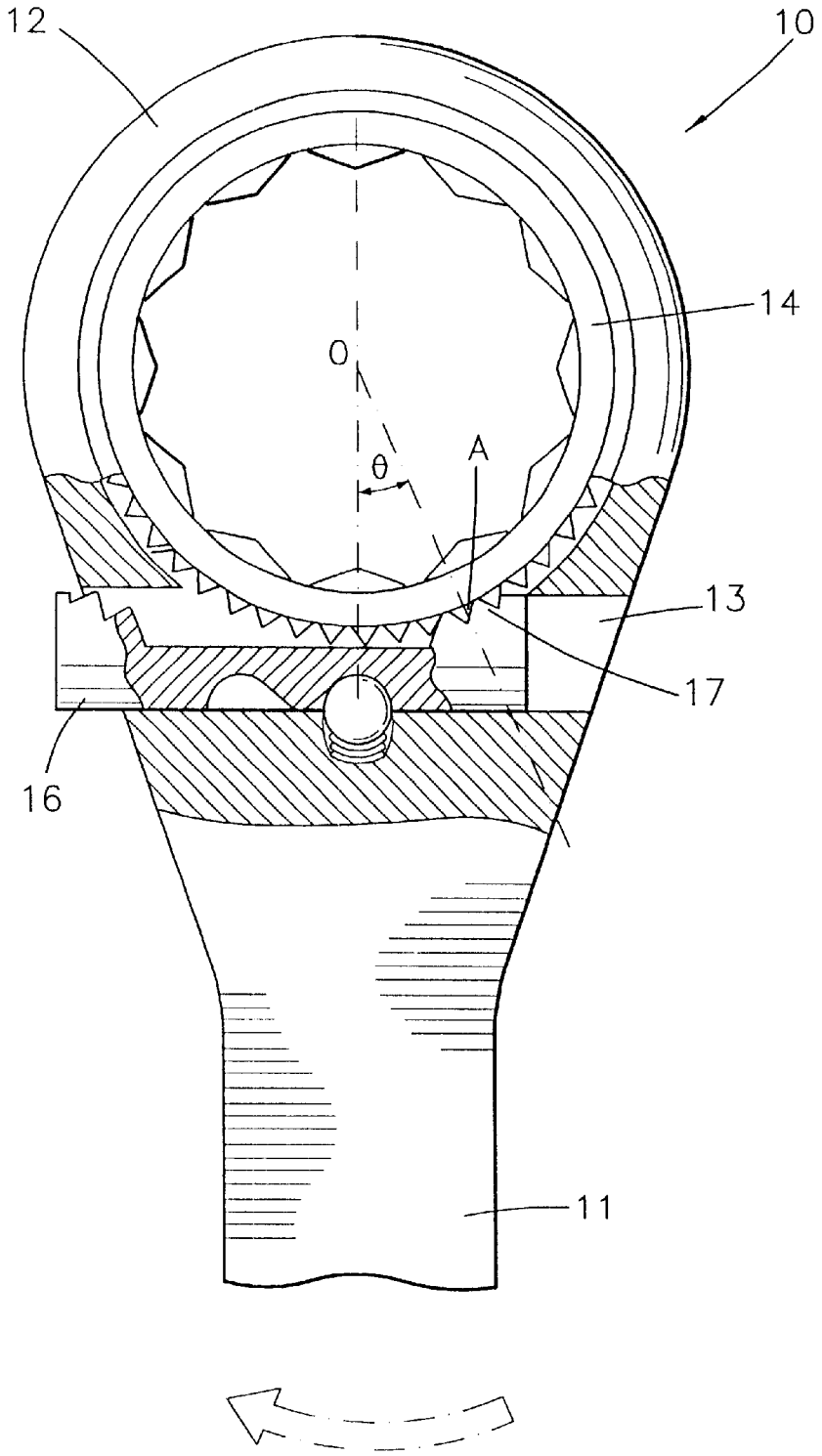
FIG. 3 PRIOR ART
FIG. 3 is a view according to FIG. 1, showing that the wrench is wrenched in reverse direction.
Figure 4:
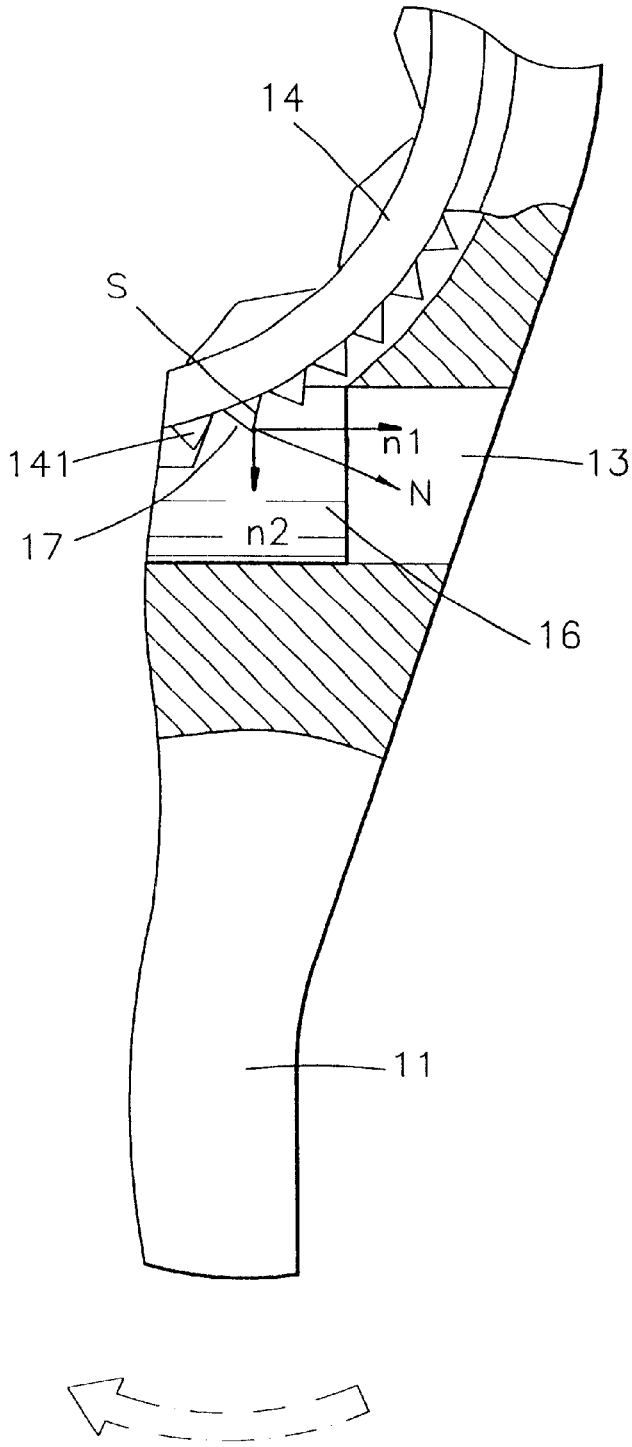
FIG. 4 PRIOR ART
FIG. 4 is an enlarged view of a part of FIG. 2.
Figure 5:
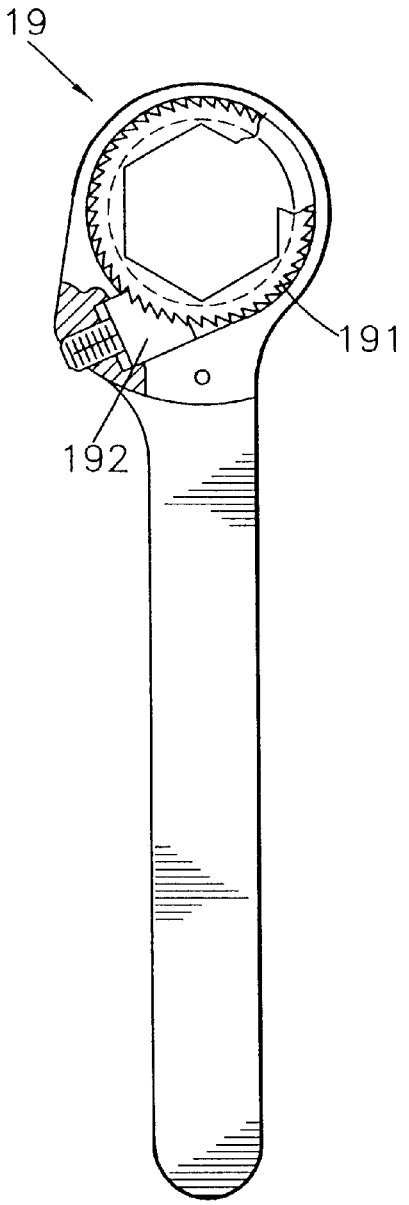
FIG. 5 PRIOR ART
FIG. 5 is a partially sectional view of another type of conventional ratchet wrench.
Figure 6:
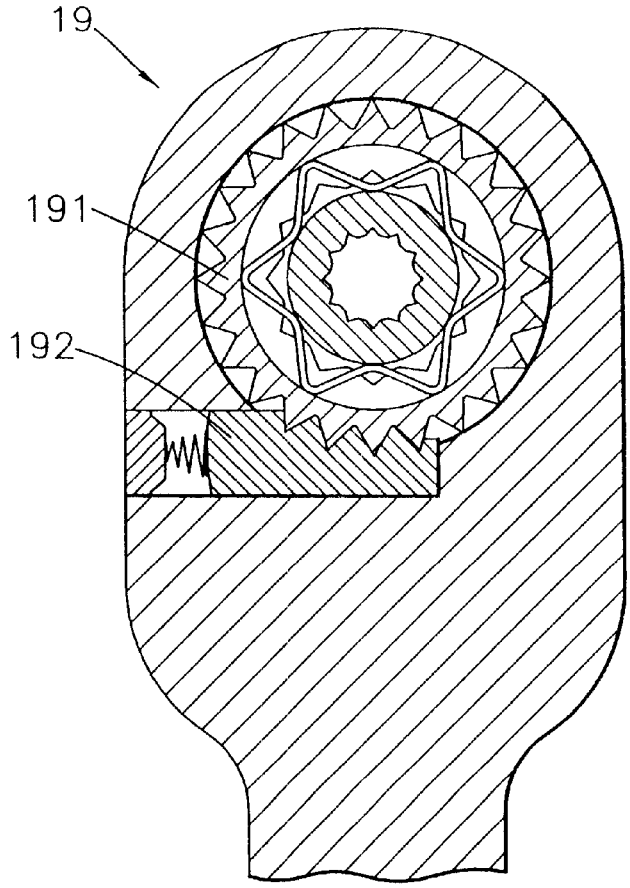
FIG. 6 PRIOR ART
FIG. 6 is a sectional view of still another type of conventional ratchet wrench.
Figures 7, 8:
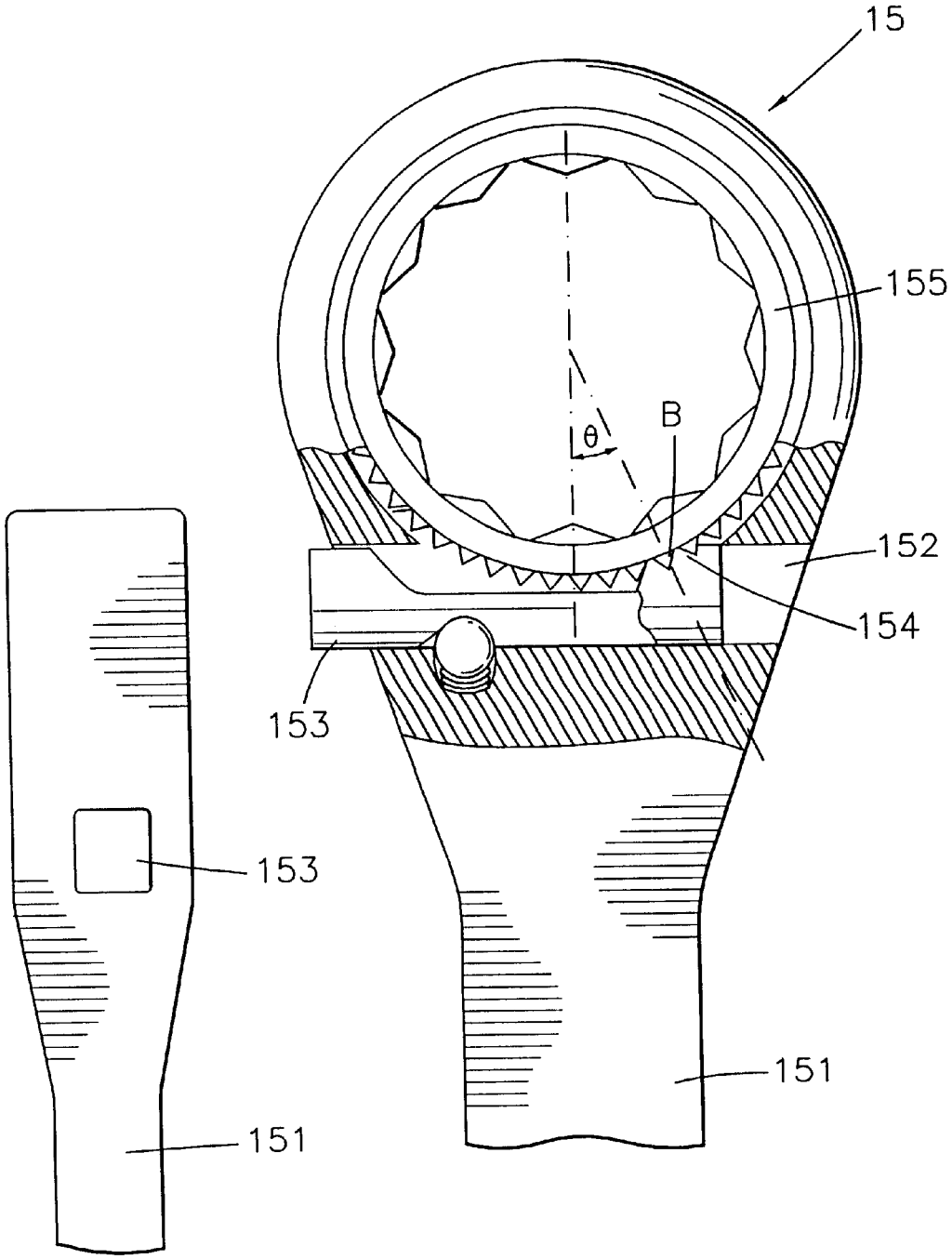
FIG. 8 PRIOR ART
FIG. 7 PRIOR ART
FIG. 7 is a sectional view of still another type of conventional ratchet wrench.
FIG. 8 is a side view according to FIG. 7.
Figure 9:
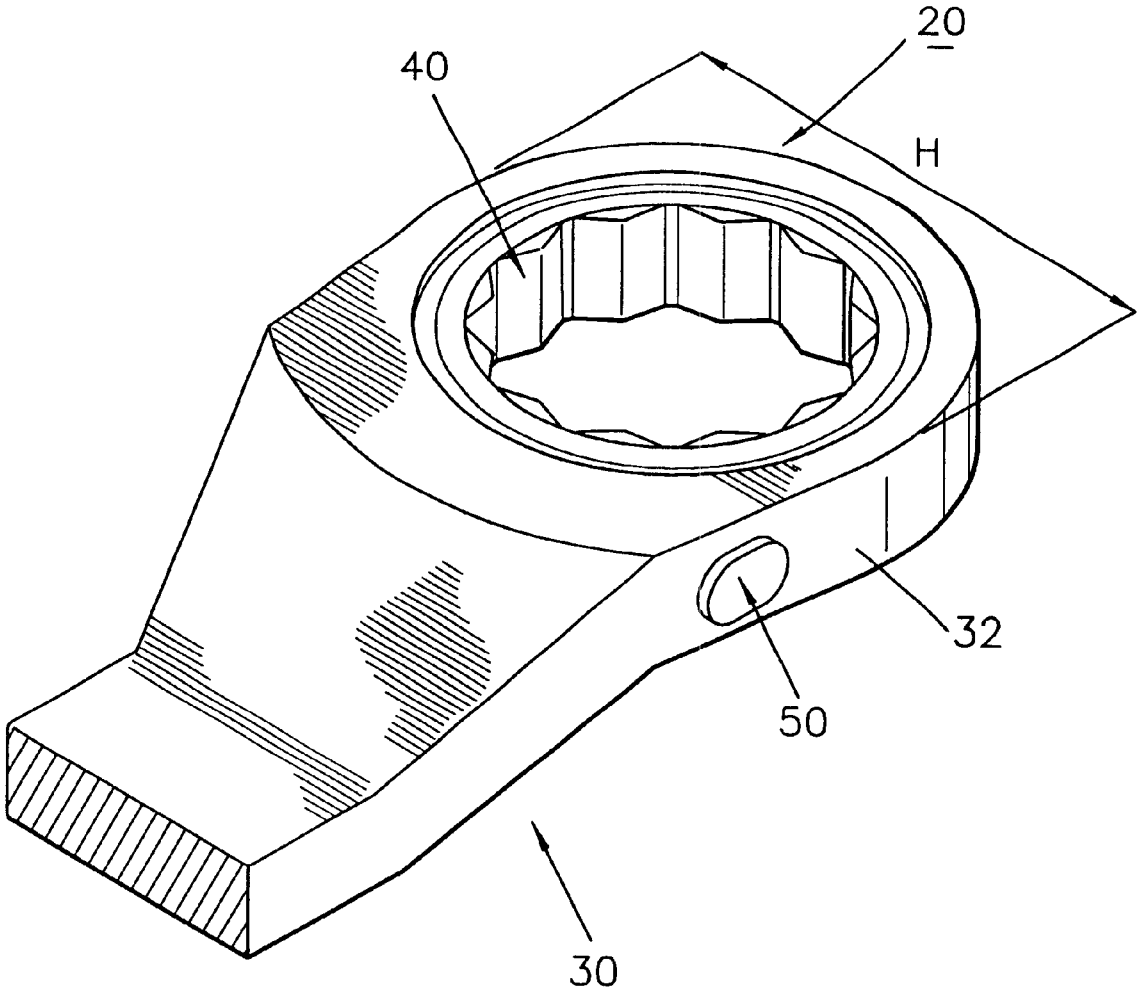
FIG. 9 is a perspective assembled view of a preferred embodiment of the present invention.
Figure 10:
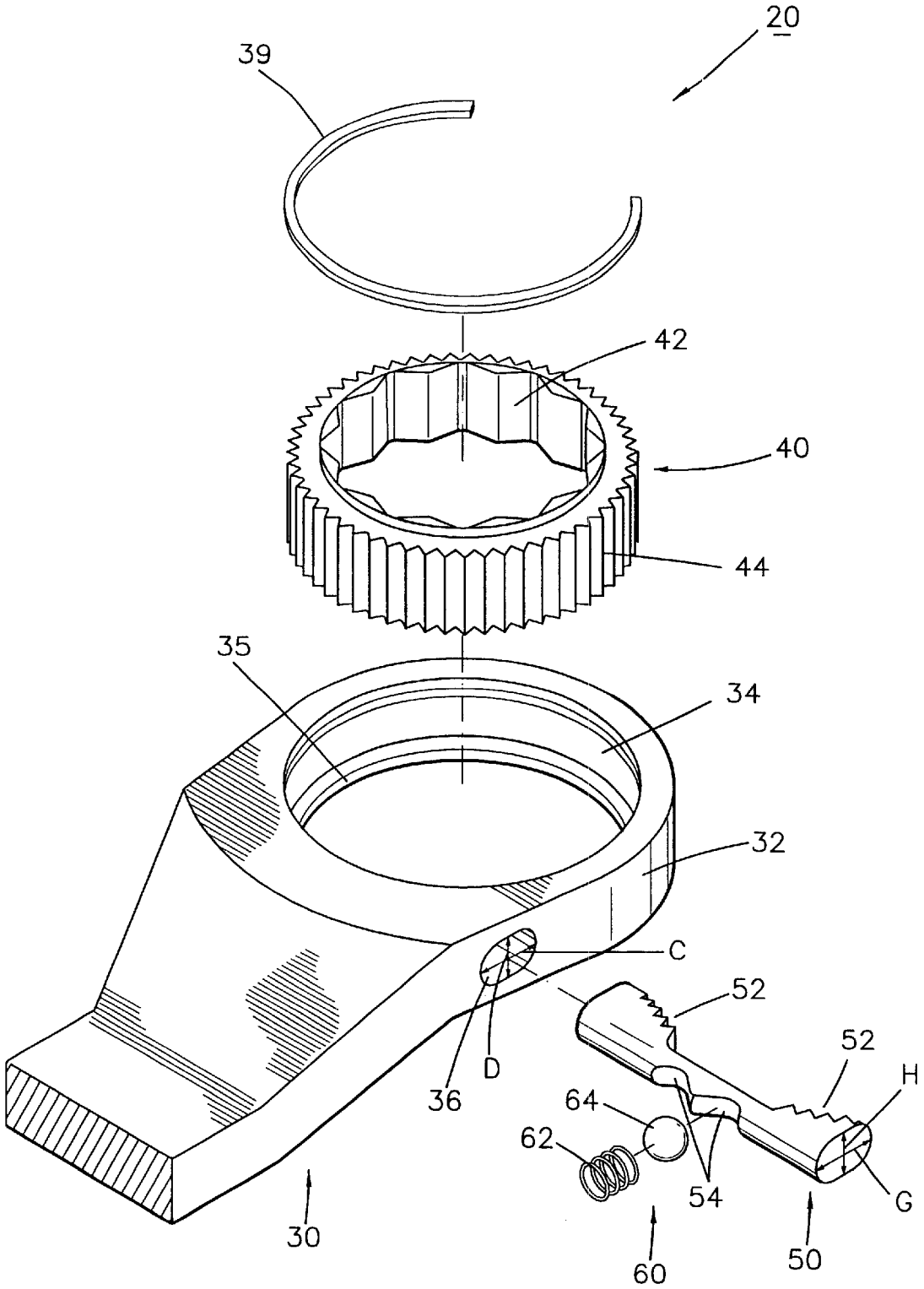
FIG. 10 is a perspective exploded view of the embodiment of FIG. 9.
Figure 11:
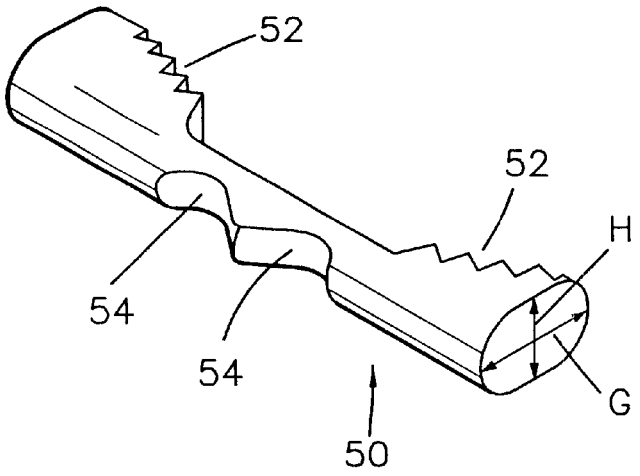
FIG. 11 is an enlarged view of the push bar of FIG. 9.
Figure 12:
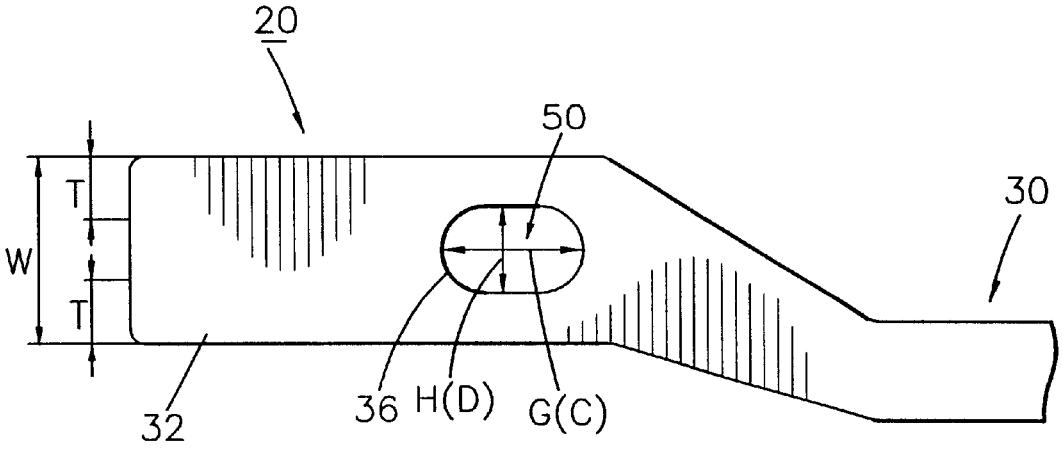
FIG. 12 is a side view according to FIG. 9.

Please refer to FIGS. 9, 10 and 11. The push bar-type ratchet wrench 20 of the present invention includes:

- a stem body 30 one end of which is a holding end 32 formed with a through hole 34 and a slide way 36 transversely passing through the holding end 32 and communicating with the through hole 34, the slide way 36 having an elliptic cross-section with a major axis C parallel to the plane face of the holding end 32 and a minor axis D normal to the major axis C;
- a ratchet 40 having a fitting hole 42 for fitting with a nut or a bolt, an outer circumference of the ratchet 40 being continuously formed with multiple teeth 44, the ratchet 40 being rotatably positioned in the through hole 34 of the holding end and restricted by an annular wall 35 of the through hole 34 and a C-shaped latch ring 39;
- a push bar 50 having an elliptic cross-section with a horizontal axis G and a vertical axis H, the length of the horizontal axis G being larger than the length of the vertical axis H, a front edge of the push bar 50 being formed with a substantially arch recess, each of two sides of the push bar 50 being formed with a detent section 52, the push bar 50 being slidably positioned in the slide way 36, the horizontal and vertical axes G, H of the push bar 50 respectively corresponding to the major and minor axes C, D of the slide way as shown in FIG. 12; and a locating member 60 including a spring 62 and a steel ball 64 which are positioned in a dent 37 of the stem body 30 for resiliently pushing one of two locating sections 54 formed on rear edge of the push bar 50. Accordingly, the push bar 50 has two locations in the slide way. At each location, one of the two detent sections 52 is resiliently engaged with the teeth 44 of the ratchet.

The present invention provides a ratchet effect for wrenching a screw fastening member as the conventional wrench.

Figure 13:
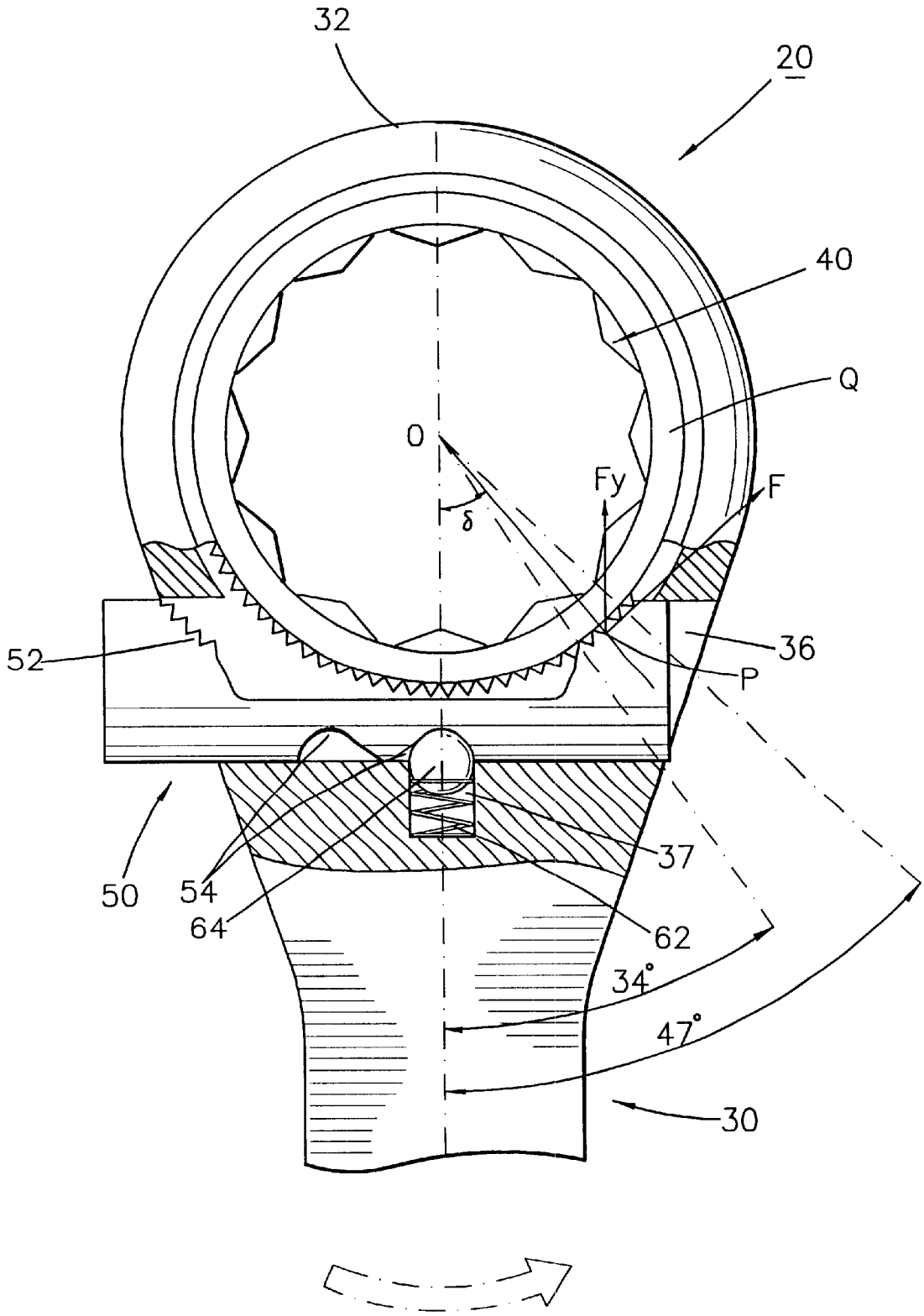
FIG. 13 is a top partially sectional view of the embodiment of FIG. 9, showing that the wrench is wrenched.

In the state of FIG. 13, the push bar 50 is positioned at one location with the detent section 52 on right side engaged with the ratchet 40 within a range of 34 to 47 degrees. When counterclockwise wrenching the stem body 30, the push bar drives the ratchet to rotate in the same direction for wrenching a screw fastening member. The horizontal axis G of the push bar has a length larger than that of the conventional push bar so that the detent section 52 is engaged with the ratchet at a higher position P. The position P and the axis of the stem body 30 contain a larger angle δ. At the contact position, the detent section 52 exerts an application force F onto the teeth 44 of the ratchet 40. The longitudinal component Fy of the application force F is directed to the ratchet. The contact position P is higher so that the longitudinal component Fy acts on a position closer to the solid portion Q of the outer circumference of the ratchet. The portion Q is more distal from the hollow section of the ratchet so that the ratchet has better strength for bearing higher torque.

Figure 14:
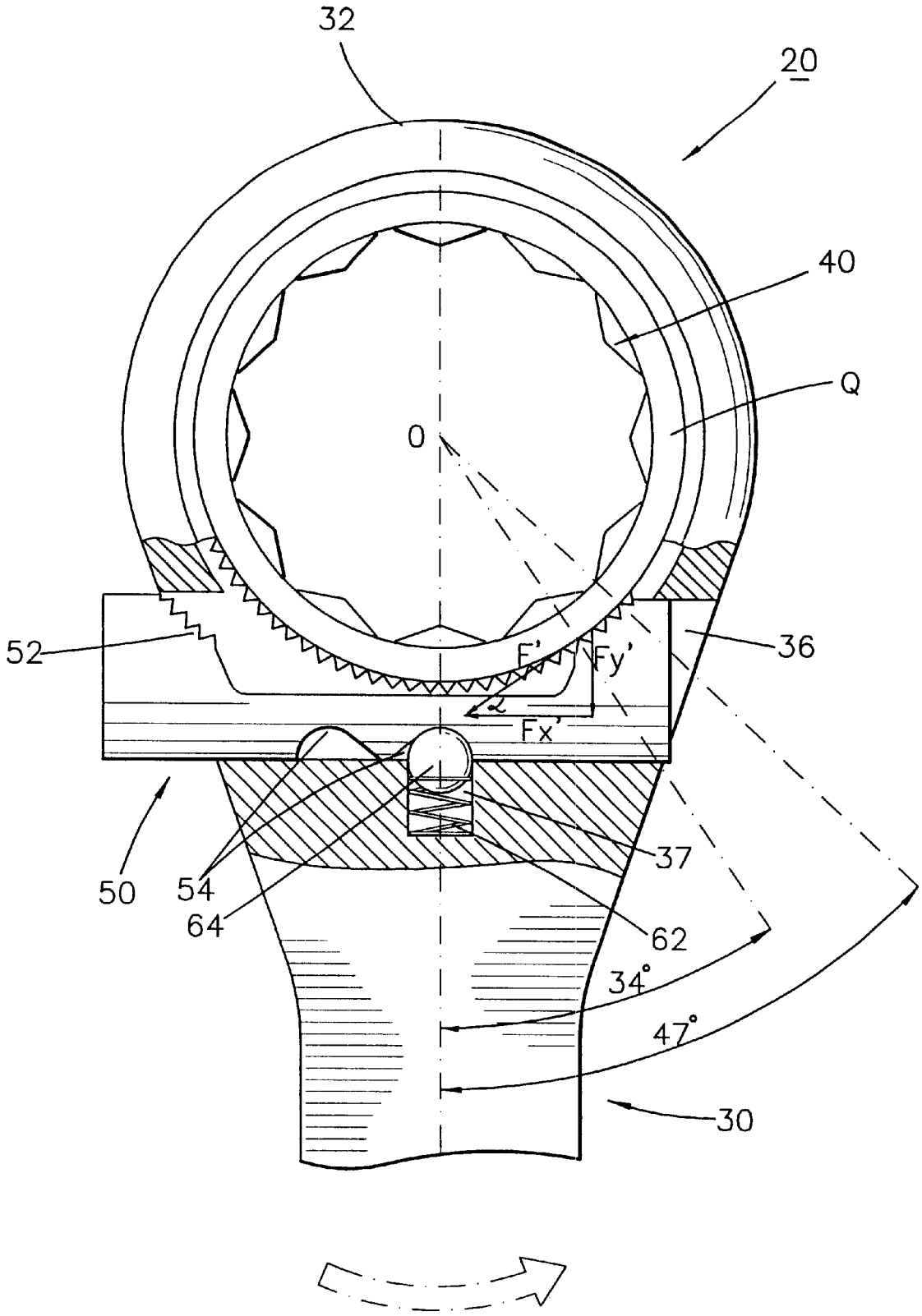
FIG. 14 is a view according to FIG. 13, showing a state of reaction.

Referring to FIG. 14, in the operation state of FIG. 13, the ratchet 40 will exert a reaction force F' onto the push bar 50. The engagement position is higher than that of the conventional wrench so that the transverse component Fx' of the reaction force F' is reduced and the possibility of clog of the push bar in the slide way is minimized.

Figure 15:
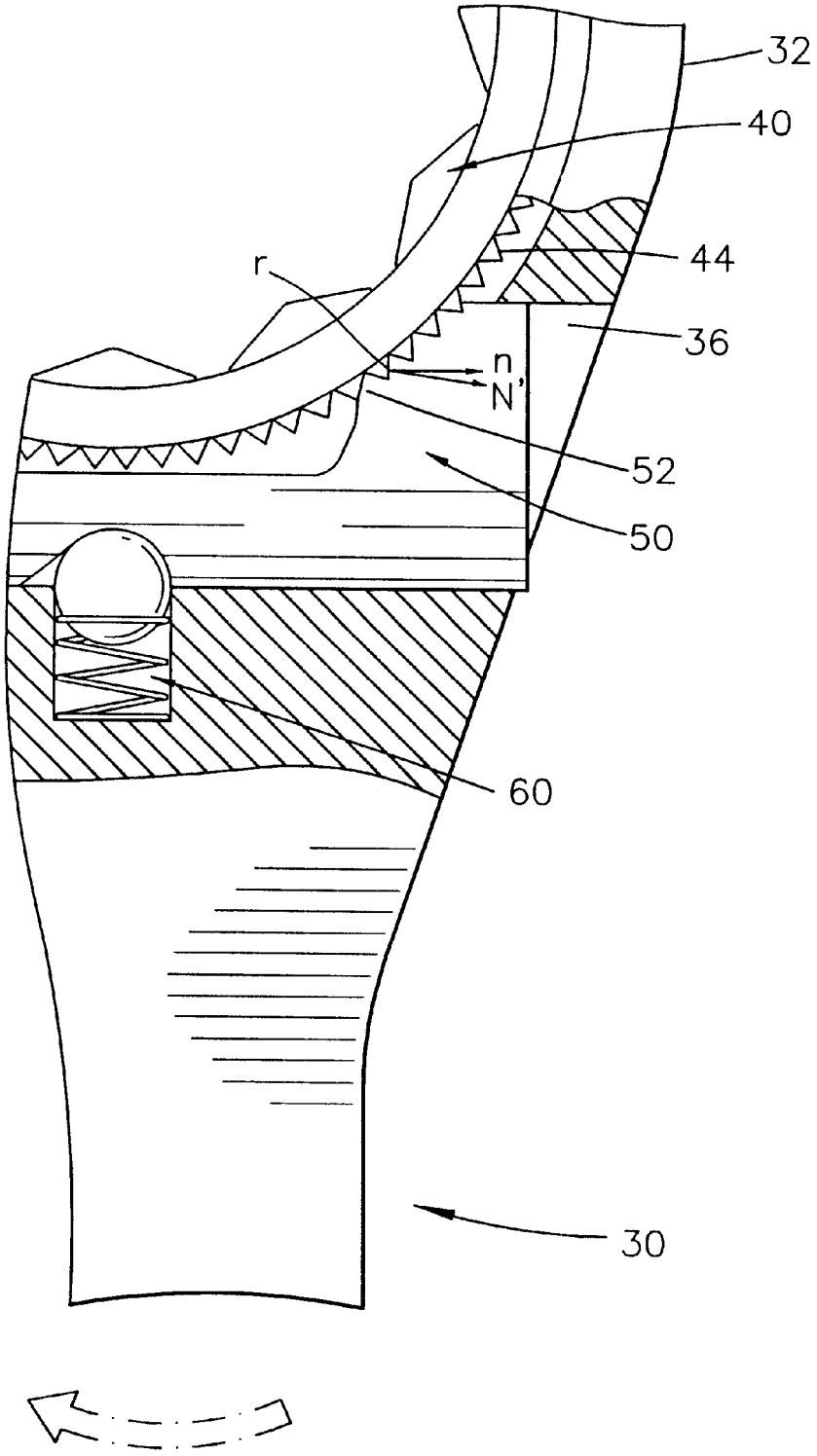
FIG. 15 is an enlarged view of a part of FIG. 13, showing that the wrench is wrenched in reverse direction.

When clockwise wrenching the wrench, as shown in FIG. 15, the ratchet 40 will push the detent section 52 rightward to disengage the push bar 50 from the ratchet and provide a ratchet effect. When the slope face r of the tooth 44 of the ratchet 40 pushes the detent section 52, almost all the application force N' becomes horizontal component n so that almost all the force is applied by the ratchet for transversely pushing the push bar 50 and there is almost no vertical component for pushing the push bar to abut against the inner wall of the slide way 36. Therefore, the frictional coefficient against the push bar is greatly reduced and the push bar 50 can be easily pushed by the ratchet 40 to slide with higher sensitivity.

According to the above, in the present invention, the engagement position of the push bar and the ratchet is changed, enabling the ratchet to bear greater torque and enhancing the sensitivity of the ratchet effect.

Furthermore, as shown in FIG. 12, the length of the minor axis D of the slide way 36 is not increased so that the thickness of the wrench is not increased and the wrench of the present invention is still applicable in a narrow space.

The ratio of the cross-section of the holding end 32 relates to the strength of the total wrench. The area of cross-section of the holding end: U=width H×thickness W. The remaining cross-section of the holding end: V=width H×(W-2T). According to the test data of the applicant, the safety coefficient is S, $$S = \frac{V}{U} = \frac{W-(2T)}{W} = 0.24 \sim 0.37$$

What is claimed is:

1. Push bar-type ratchet wrench with high torque strength, comprising:

a stem body, one end of which is a holding end formed with a through hole and a slide way transversely passing through the holding end and communicating with the through hole;

a ratchet, an outer circumference of the ratchet being continuously formed with multiple teeth, the ratchet being rotatably positioned in the through hole;

a push bar, at least one side of a front edge of the push bar being formed with a detent section, the push bar being slidably positioned in the slide way; and a locating member positioned in the stem body resiliently pushing against the push bar, so that said detent section is engaged with the ratchet; whereby:

the slide way has a cross-section with a first axis parallel to a plane face of the holding end and a second axis normal to the first axis, the first axis having a length larger than that of the second axis; and the push bar has a cross-section with a horizontal axis and a vertical axis, the horizontal axis having a length larger than that of the vertical axis, the first axis of the slide way corresponding to the horizontal axis of the push bar, the second axis of the slide way corresponding to the vertical axis of the push bar, whereby the detent section is engaged with the ratchet at a higher position for increasing a torque strength and operation sensibility thereof; and wherein the range within which the ratchet is engaged with the detent section of the push bar and the axis of the stem body contain an angle of 34 degrees to 47 degrees.

2. Ratchet wrench as claimed in claim 1, wherein the slide way and the push bar have elliptical cross-sections.

* * * * *